US008698028B2

(12) United States Patent
Ishigame et al.

(10) Patent No.: US 8,698,028 B2
(45) Date of Patent: Apr. 15, 2014

(54) PUSH-ON SWITCH

(75) Inventors: Akira Ishigame, Okayama (JP); Yasunori Yanai, Okayama (JP)

(73) Assignee: Panasonic Corporation, Osaka (JP)

( * ) Notice: Subject to any disclaimer, the term of this patent is extended or adjusted under 35 U.S.C. 154(b) by 130 days.

(21) Appl. No.: 13/372,533

(22) Filed: Feb. 14, 2012

(65) Prior Publication Data

US 2012/0241302 A1 Sep. 27, 2012

(30) Foreign Application Priority Data

Mar. 23, 2011 (JP) ..... 2011-063818

(51) Int. Cl.
*H01H 5/18* (2006.01)

(52) U.S. Cl.
USPC ..... 200/406

(58) Field of Classification Search
USPC ..... 200/530, 406, 513
IPC ..... H01H 13/48
See application file for complete search history.

(56) References Cited

U.S. PATENT DOCUMENTS

| | | | | |
|---|---|---|---|---|
| 5,828,016 | A * | 10/1998 | Grannan et al. | 200/16 R |
| 6,936,777 | B1 * | 8/2005 | Kawakubo | 200/1 B |
| 7,589,607 | B2 * | 9/2009 | Rochon et al. | 335/205 |
| 2003/0015411 | A1 | 1/2003 | Watanabe et al. | |
| 2003/0213686 | A1 | 11/2003 | Takeuchi et al. | |
| 2008/0164133 | A1 * | 7/2008 | Hayafune | 200/516 |
| 2011/0089004 | A1 * | 4/2011 | Yanai et al. | 200/275 |

FOREIGN PATENT DOCUMENTS

| | | |
|---|---|---|
| JP | 2002-063823 | 2/2002 |
| JP | 2003-297175 | 10/2003 |

* cited by examiner

*Primary Examiner* — Vanessa Girardi
(74) *Attorney, Agent, or Firm* — Wenderoth, Lind & Ponack, LLP.

(57) ABSTRACT

A push-on switch includes a first contact plate, second contact plate, spacer, movable contact, and lid. The first plate has a projection at its center and a first terminal at its end. The second plate faces a face of the projection of the first contact plate and has an opening at its center and a second terminal at its end. The spacer is interposed between the first plate and the second plate for bonding them together. The movable contact is shaped like a dome and has a protrusion protruding downward and touches a top face of the second plate. The protrusion faces the projection of the first plate via the opening with a given space therebetween. The lid holds the movable contact and is mounted on the top face of the second plate. A push onto the movable contact reverses the movable contact downward, which allows the protrusion to touch the projection.

12 Claims, 7 Drawing Sheets

PUSH-ON SWITCH

FIELD OF INVENTION

The present invention relates to a push-on switch to be used in an operating section of a variety of electronic devices.

BACKGROUND OF INVENTION

In recent years, various electronic devices have been downsized made light-weight, and yet sophisticated. This market trend also requires downsizing of push-on switches to be used in operating sections of the electronic devices.

A conventional push-on switch is described hereinafter with reference to FIG. 8-FIG. 10. FIG. 8 is a sectional view of the conventional push-on switch, and FIG. 9 is an exploded perspective view of the conventional push-on switch. FIG. 10 is a sectional view illustrating the conventional push-on switch depressed. Housing 1 is made of synthetic resin and includes an opening at the top face. On a recessed inner bottom face of housing 1, there are center fixed contact 2 made of metal and two outer fixed contacts 3 made of metal and disposed symmetrically relative to center fixed contact 2. In other words, center fixed contact 2 is interposed between the two outer fixed contacts 3. Terminal 2A connected to center contact 2 and terminal 3A connected to outer fixed contacts 3 are led outside housing 1.

Movable contact 4 is made of an elastic thin metal plate and forms a dome bowing upward. The underside of movable contact 4 is surface-treated for good electrical conductivity. Movable contact 4 is accommodated in the recess of housing 1, and a lower end of the rim of movable contact 4 is seated on outer fixed contacts 3. The center section of the underside of movable contact 4 faces the top face of center fixed contact 2 with a space therebetween.

Protective sheet 5 is formed by applying pressure-sensitive adhesive (not shown) onto the underside of an insulating film, and protective sheet 5 is fixed on housing 1 with the adhesive such that sheet 5 can cover the top face of the recess of housing 1.

The conventional push-on switch is constructed as discussed above. The operation of this switch is described hereinafter. First, depressing force is applied from above protective sheet 5 to the center section of domed (bowing upward) movable contact 4, and when the depressing force exceeds a given level, the center section of movable contact 4 elastically reverses (protruding downward or bowing downward) with tactile click-feel as shown in FIG. 10. Movable contact 4 then touches center fixed contact 2 with the center section of the underside of movable contact 4. Outer fixed contacts 3 become electrically conductive to center fixed contact 2 via movable contact 4, so that terminals 2A and 3A corresponding respectively to center contact 2 and outer contacts 3 are placed into a switch-on state.

When the depressing force is removed, the center section of movable contact 4 elastically restores to the original shape, i.e. bowing upward, with tactile click-feel, and movable contact 4 leaves center fixed contact 2 at the center of the underside of movable contact 4. The terminals 2A and 3A are thus placed in a switch-off state.

Prior art related to the present invention includes Japanese Patent Unexamined Publications No. 2003-297175 and No. 2002-63823.

Housing 1 of the foregoing conventional push-on switch is formed by insert-molding the center fixed contact 2, outer fixed contacts 3, and terminals 2A and 3A together, where terminals 2A and 3A correspond to contact 2 and contacts 3.

This structure tends to invite a shortage of synthetic resin at a thin-wall section in a case where the thickness of housing 1 is reduced, so that it is difficult to further downsize housing 1 or reduce the thickness of housing 1.

SUMMARY OF INVENTION

The present invention aims to provide a small size push-on switch that adopts an innovative structure in the member corresponding to the housing of a conventional switch for reducing the thickness, and on top of that, the push-on switch is excellent in contact stability while it is operated.

The push-on switch of the present invention has a first contact plate, a second contact plate, a spacer, a movable contact, and a lid. The first contact plate includes a projection at the center and a first terminal at the end thereof. The second contact plate faces a face of the projection of the first contact plate, and the second contact plate includes an opening at the center and a second terminal at the end thereof. The spacer is interposed between the first contact plate and the second contact plate for bonding them together. The movable contact forms a dome, includes a protrusion protruding downward, and this protrusion faces the projection of the first contact plate via the opening with a given space therebetween. The lid holds the movable contact and is mounted on the top face of the second contact plate such that a push onto the movable contact reverses the movable contact downward and the protrusion can be brought into contact with the projection.

A housing, outer fixed contacts, and a center fixed contact of the conventional push-on switch are changed into a laminated structure, i.e. two sheets of contact plates made of conductive thin metal sheet are bonded to a spacer placed therebetween so that the two sheets are bound together. This structure allows for a low-profile push-on switch of which the thickness can be reduced in response to each thickness of the two contact plates and the spacer.

DESCRIPTION OF EMBODIMENT

An exemplary embodiment of the present invention is demonstrated hereinafter with reference to accompanying FIG.

Figure 1:
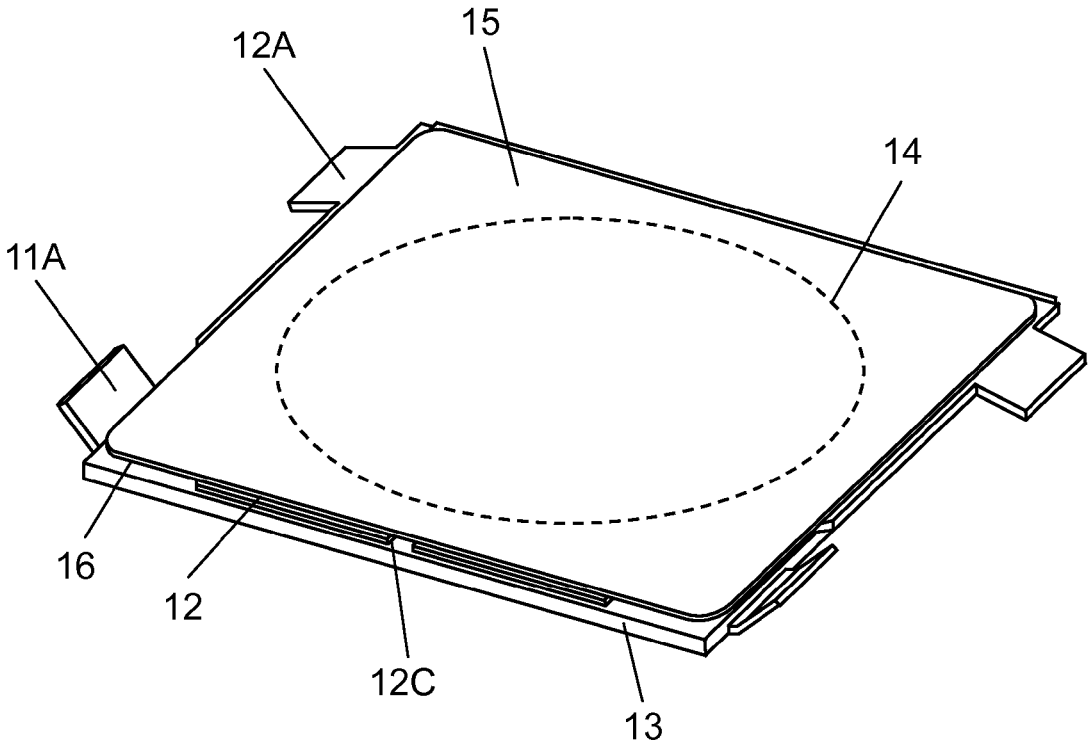
FIG. 1 shows an appearance of a push-on switch in accordance with an embodiment of the present invention.
Figure 2:
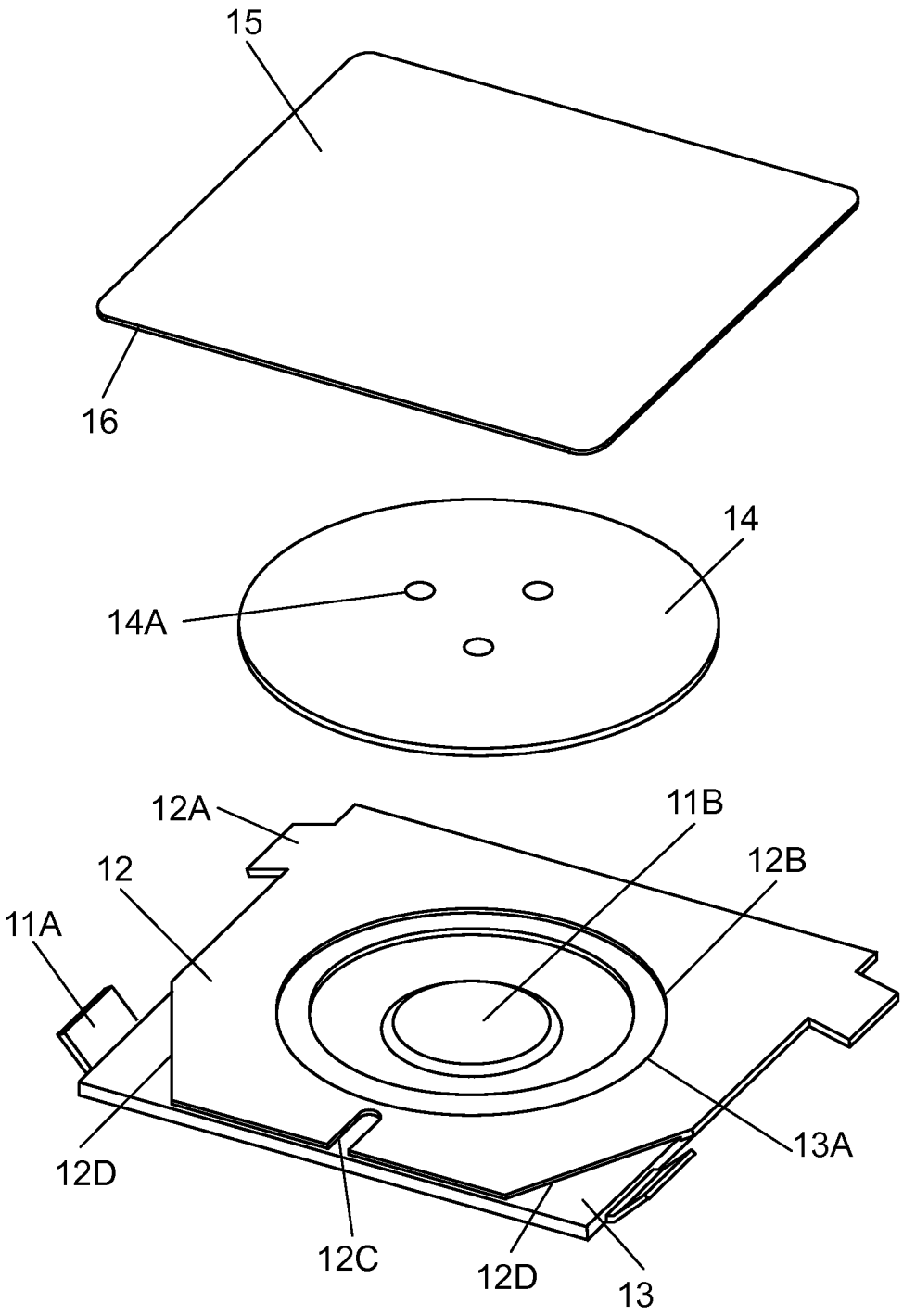
FIG. 2 is an exploded perspective view of the push-on switch in accordance with the embodiment of the present invention.
Figure 3:
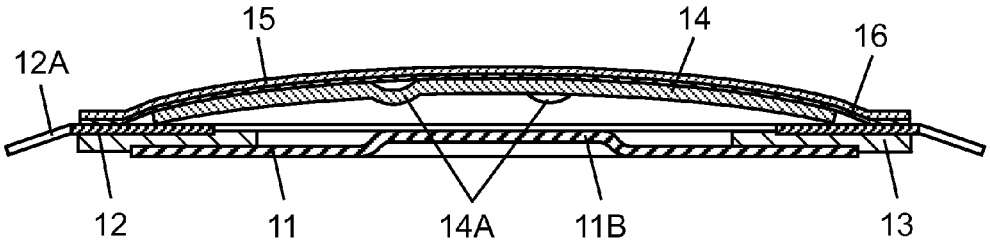
FIG. 3 is a sectional view of the push-on switch in accordance with the embodiment of the present invention.
Figure 4:
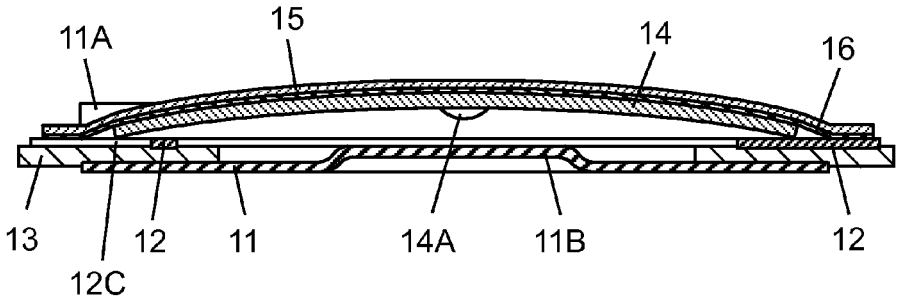
FIG. 4 is a sectional view cut along a place including a slit of the push-on switch in accordance with the embodiment of the present invention.
Figure 5:
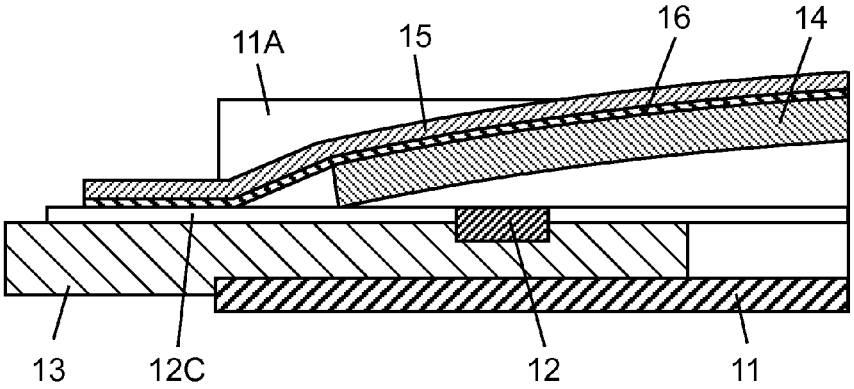
FIG. 5 is a sectional view enlarging the slit of the push-on switch in accordance with the embodiment of the present invention.
Figure 6:
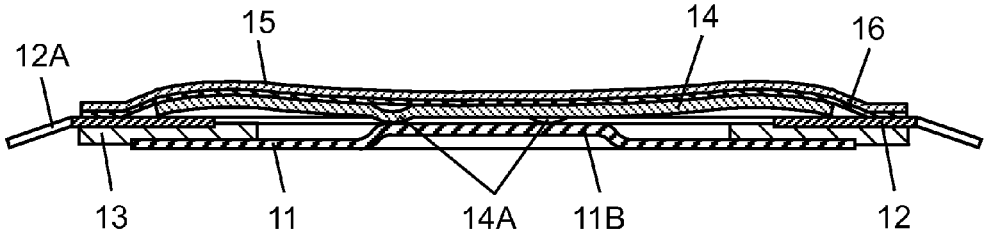
FIG. 6 is a sectional view of the push-on switch, when it is depressed, in accordance with the embodiment of the present invention.

1-FIG. 6. FIG. 1 shows an appearance of a push-on switch in accordance with an embodiment of the present invention. FIG. 2 is an exploded perspective view of the push-on switch in accordance with the embodiment of the present invention. FIG. 3 is a sectional view of the push-on switch in accordance with the embodiment of the present invention. FIG. 4 is a sectional view cut along a place including a slit of the push-on switch in accordance with the embodiment of the present invention. FIG. 5 is a sectional view enlarging the slit of the push-on switch in accordance with the embodiment of the present invention.

FIG. 6 is a sectional view of the push-on switch, when it is depressed, in accordance with the embodiment of the present invention. Push-on switch 100 includes first contact plate 11, second contact plate 12, spacer 13, movable contact 14, and protective sheet 15 working as a lid. First contact plate 11 has projection 11B at the center and first terminals 11A at the ends thereof. Second contact plate 12 faces a face of protruding projection 11B of first contact plate 11 and has opening 12B at the center and second terminals 12A at the ends thereof. Spacer 13 is interposed between first contact plate 11 and second contact plate 12 for bonding plate 11 and plate 12 together. Movable contact 14 forms a domed shape and has protrusions 14A protruding downward. Movable contact 14 is brought into contact with a top face of second contact plate 12, and protrusions 14A face to projection 11B of first contact plate 11 via opening 12B with a given space therebetween. Protective sheet 15 holds movable contact 14 and is mounted onto the top face of second contact plate 12. Protrusions 14A are disposed in a position to come into contact with projection 11B when movable contact 14 is pushed and reversed downward.

Each one of the foregoing structural elements is detailed hereinafter. First contact plate 11 is made of good-conductive metal sheet, e.g. a stainless steel sheet silver-plated on both the faces, and is formed like a rectangular plate. Each one of first terminals 11A protrudes outward from the two sides opposite to each other of first contact plate 11. First terminals 11A are placed at the ends of the two sides line-symmetrically. First contact plate 11 includes projection 11B embossed upward at the center of plate 11 and shaped like a truncated cone.

Second contact plate 12 is made of good-conductive metal sheet, e.g. a stainless steel sheet silver-plated on both the faces, and is formed like a rectangular plate. Second contact plate 12 disposed opposite to first contact plate 11, and has circular opening 12B, at the center, having a greater diameter than that of a top face of projection 11B. Second contact plate 12 has two second terminals 12A disposed line-symmetrically with the two first terminals 11A and protruding outward. First terminals 11A are bent at their roots toward second contact plate 12, and second terminals 12A are also bent at their roots toward first contact plate 11.

Spacer 13 forms a film-like rectangular plate, and is made of LCP resin (Liquid Crystal Polymer) and is disposed between first contact plate 11 and second contact plate 12. Spacer 13 has circular opening 13A at the center, and opening 13A forms the same shape as or a smaller shape than opening 12B of second contact plate 12, and has a diameter greater than that of the top face of projection 11B. Spacer 13 is provided at an entire section, where first contact plate 11 overlaps with second contact plate 12, viewed from the top, thereby maintaining the insulation between first contact plate 11 and second contact plate 12. The top face and the underside of spacer 13 are bonded to first contact plate 11 and second contact plate 12, respectively. In other words, as shown in FIG. 3, first contact plate 11, spacer 13, and second contact plate 12 are layered in this order from the bottom, so that they can be integrated into one body.

A method of manufacturing the foregoing push-on switch is demonstrated hereinafter. Hold spacer 13 between first contact plate 11 and second contact plate 12, and then apply heat and pressure from under first contact plate 11 on which projection 11B has been formed, and also apply heat and pressure from above second contact plate 12. This thermo-compression softens spacer 13 made of LCP resin and generates an anchor effect, so that both the surfaces of spacer 13 are rigidly bonded to the respective surfaces of first contact plate 11 and second contact plate 12. As a result, first contact plate 11, spacer 13, and second contact plate 12 are integrated into one body without using adhesive.

Second contact plate 12 integrated with first contact plate 11 has two cut-away sections 12D at two corners close to first terminals 11A. In a similar way, first contact plate 11 has two cut-away sections (not shown) at two corners close to second terminals 12A. The presence of cut-away sections 12D allows for the prevention of a short between first terminals 11A and second contact plate 12 when push-on switch 100 is mounted to a printed circuit board by soldering. A short between second terminals 12A and first contact plate 11 thus can be also prevented. Since the LCP resin of spacer 13 is softened by the thermo-compression, it flows into these cut-away sections 12D, and then hardens there.

First contact plate 11 viewed from the top is smaller than second contact plate 12. This structure allows the softened LCP resin to flow in the periphery of plate 11 where it hardens, as the LCP resin does in cut-away sections 12D. This structure allows the insulation after the assembly to be more steadily maintained between plate 11 and plate 12 at the peripheries. In this embodiment, first contact plate 11 is smaller than second contact plate 12 viewed from the top; however, contrary to this structure, second contact plate 12 can be smaller than first contact plate 11 with the same advantage as discussed previously.

Spacer 13 can be made of types of resin other than the LCP resin, for instance, thermoplastic resin such as 9T nylon or PPS (Poly Phenylene Sulfide).

Movable contact 14 is made of an elastic thin metal sheet of which the underside is surface-treated for good-conductivity, and forms a round dome bowing upward or projecting upward. At the center of the underside of movable contact 14, three protrusions 14A spherically formed are placed along a virtual circle having a center at the center of movable contact 14, and three protrusions 14A are placed at intervals of 120° and protrude downward. In this embodiment, movable contact 14 forms a circle viewed from the top; however, it can be an oval or a polygon such as a rectangular shape. The shape, placement, and the number of protrusions 14A are not limited to specific ones, but multiple protrusions 14A as prepared in this embodiment are preferable because steady contact at multi-points can be produced by a switch operation.

Movable contact 14 is placed directly on second contact plate 12 and its underside at the center faces to the top face of first contact plate 11 via opening 12B of second contact plate 12 and opening 13A of spacer 13. Projection 11B shaped like a truncated cone has a top face of which the diameter is somewhat greater than that of the virtual circle along which three protrusions 14A are placed. When movable contact 14 is elastically reversed, this structure allows protrusions 14A to touch projection 11B at a rim of the top face close to the slanting face forming a sidewall of projection 11B, that is to say the structure allows protrusion 14A to touch projection 11B at a vicinity of a rim of the top face of the projection 11B.

The touch points between protrusions 14A and projection 11B can be on the slanting face of the sidewall of projection 11B. This structure allows protrusions 14A to be supported indirectly by the sidewall of projection 11B, so that even if switch 100 is pushed repeatedly, projection 11B scarcely encounters a cave-in. A height of projection 11B and heights of protrusions 14A can be determined appropriately so that the distance between the contacts can be set properly with ease.

Protective sheet 15 is made of an insulating, rectangular film and includes adhesive layer 16 on the entire underside. Adhesive layer 16 thus allows protective sheet 15 to be mounted rigidly onto the top face of second contact plate 12, so that protective sheet 15 works as a lid. Adhesive layer 16 also holds and positions movable contact 14 onto second contact plate 12. Protective sheet 15 preferably employs heat-resistant insulating film, e.g. polyimide resin. Adhesive layer 16 preferably employs heat-resistant acrylic-based adhesive agent. In this embodiment, rectangular protective sheet 15 is employed; however, the shape of sheet 15 can be appropriately selected depending on the shape and size of the switch. As discussed above, use of protective sheet 15 having adhesive layer 16 allows protective sheet 15 to solidly stick onto second contact plate 12 with ease. Protective sheet 15 can be made of the LCP resin as spacer 13 is. In this case, protective sheet 15 can be mounted onto second contact plate by thermo-compression instead of using adhesive layer 16.

On top of that, as shown in FIGS. 2, 4, and 5, an air opening is preferably provided for communicating between the outside and the inside of movable contact 14. To be more specific, second contact plate 12 is preferably provided with slit 12C, which works as the air opening, starting from an edge of the periphery toward opening 12B. Slit 12C forms a linear shape having a width of approx. 0.15 mm, and its tip forms an arc. The length of slit 12C is determined such that it runs from inside of the lower end of the rim of movable contact 14 until before it reaches opening 12B. In other words, the air trapped in the space covered by the underside of movable contact 14 can flow outward through slit 12C from the vicinity of the inside of the lower end of the rim of movable contact 14. This structure prevents slowdown of the tactile click-feel of the switch when movable contact 14 stays in a compressed state or in a negative pressure state in response to the operation of the movable contact 14, because the air trapped in movable contact 14 can flow out or flow in through the air opening formed of slit 12C.

Slit 12C can reach opening 12B; however, the foregoing structure, i.e. slit 12C ends before it reaches opening 12B, and prevents second contact plate 12 from twisting at slit 12C during the manufacturing process, so that the productivity can be improved.

The push-on switch in accordance with the embodiment is thus structured as discussed previously. The operation of this switch is demonstrated hereinafter.

First, a user pushes the switch from the top, and depressing force is applied to the center of protective sheet 15. This depressing force is given to the top of domed movable contact 14. When the depressing force exceeds a predetermined level, the center of the domed shape of movable contact 14 reverses elastically and bows downward (protrudes downward) with tactile click-feel as shown in FIG. 6. Then protrusions 14A formed at the center of movable contact 14 touch the top face of projection 11B, existing below and facing to protrusions 14A, of first contact plate 11. This mechanism generates electrical conductivity between second contact plate 12 and first contact plate 11 via movable contact 14, so that a switch-on state is produced between second terminal 12A and first terminal 11A. At this time, the air trapped within movable contact 14 is compressed by the push, and then flows outward through slit 12C from the vicinity of the inside of the lower end of the rim of movable contact 14. In other words, the reversing action of movable contact 14 makes the compressed air flow outward, so that the reversing action gives the user a good tactile click-feel free from interference by the compressed air.

When the user removes his/her finger from the switch, i.e. removes the depressing force, movable contact 14 is restored elastically to the original domed shape, bowing upward (protruding upward), by a self-resetting force with tactile click-feel. Then a switch-off state is produced between second terminal 12A and first terminal 11A. The restoring action enlarges a cubic volume in movable contact 14, so that the inside thereof attains a negative pressure state. This mechanism allows the air outside the switch to flow into movable contact 14 via slit 12C from the lower end of the rim of movable contact 14.

As discussed above, the push-on switch in accordance with the embodiment forms a simple laminated structure in which first contact plate 11, spacer 13, and second contact plate 12 are integrated together into one body that corresponds to the housing of the conventional push-on switch. Reduction in thickness of first contact plate 11, spacer 13, and second contact plate 12, respectively, thus allows for reduction of the thickness of the push-on switch with ease.

On top of that, the conventional switch needs an outer wall for housing 1 in order to form a recess; however, the embodiment adopts the structure where movable contact 14 is disposed on second contact plate 12, so that no outer wall is needed. This structure thus allows downsizing the switch for that.

The presence of slit 12C forms the air opening that allows air to travel between the inside and the outside of movable contact 14. This structure allows the air trapped inside movable contact 14 to flow out and flow in via the air opening, for movable contact 14 attains a compressed state or a negative pressure state in response to the operation. As a result, the air inside movable contact 14 does not affect so much the operation of movable contact 14, and thus good tactile click-feel can be obtained.

The air opening is not necessarily a slit 12C, i.e. formed by cutting second contact plate 12, but it can be a groove formed depth-wise on second contact plate 12, or a similar slit can be formed on spacer 13 instead of second contact plate 12, and this slit can be used as the air opening. Any of these structures allows the air trapped inside movable contact 14 to flow out and flow in via the air opening, for movable contact 14 attains a compressed state or a negative pressure state in response to the operation. As a result, the air inside movable contact 14 does not affect so much the operation of movable contact 14, and thus good tactile click-feel can be obtained.

The structure discussed above, i.e. in which slit 12C does not reach opening 12B, is preferable because it more effectively prevents dust from entering movable contact 14 than does a structure where slit 12C reaches opening 12B. Slit 12C is not always in a linear shape but can be in a bent or curved shape.

Although it is not shown in the drawings, a cylindrical protrusion to be pressed can be formed on the top face of protective sheet 15. This protrusion is placed corresponding to the center of domed movable contact 14, and is made of, e.g. insulating resin such as polyimide resin. The protrusion can be fixed on the top face of protective sheet 15 with adhesive of thermosetting or ultraviolet-ray setting, or the protrusion can be unitarily formed with protective sheet 15.

Even if the center of the operating button of an electronic device is somewhat deviated from the center of the push switch mounted to the electronic device, e.g. a portable phone, this structure allows the movable contact to be pushed at its center via the protrusion to be pressed, so that the user can always get good tactile click-feel.

Figure 7:
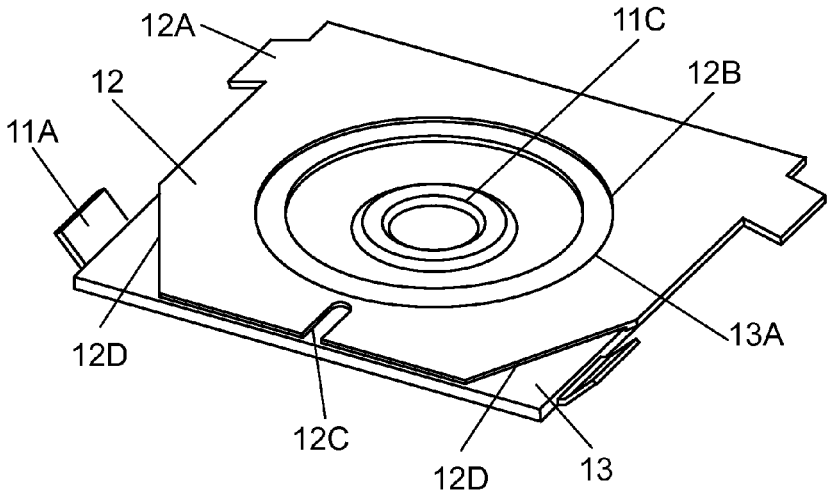
FIG. 7 is a partial exploded perspective view of another push-on switch in accordance with an embodiment of the present invention.
Figure 8:
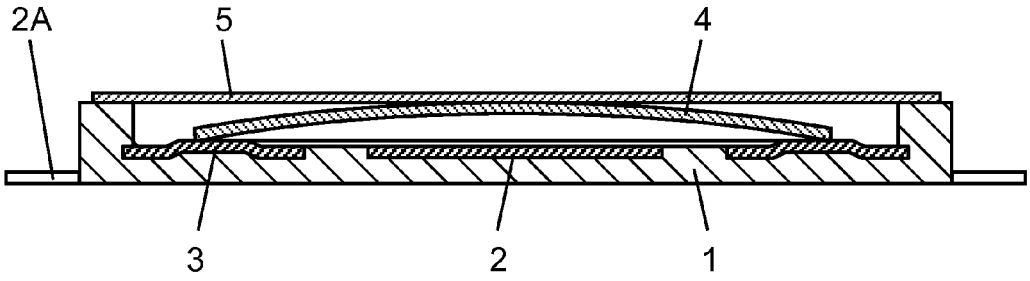
FIG. 8 PRIOR ART
FIG. 8 is a sectional view of a conventional push-on switch.
Figure 9:
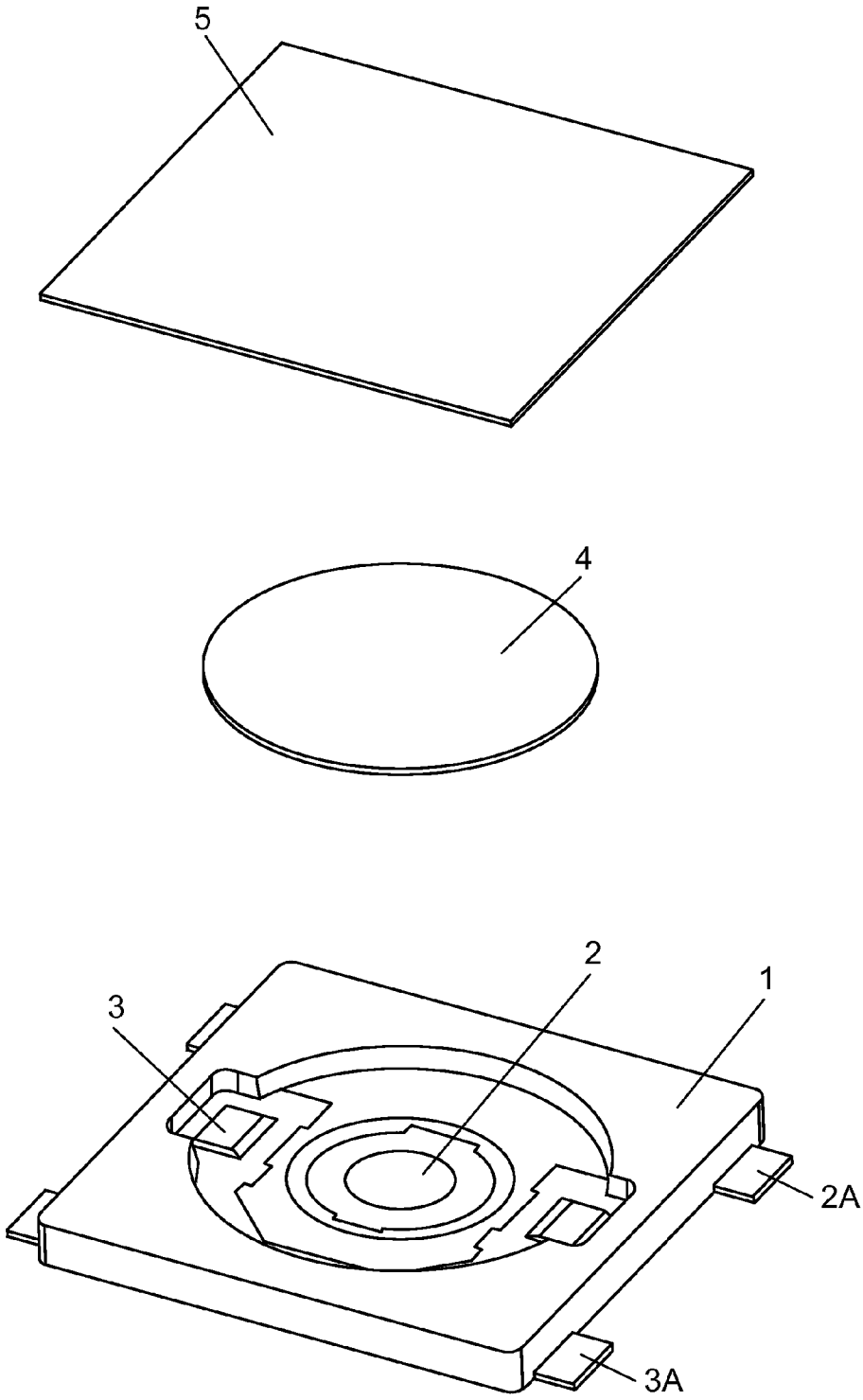
FIG. 9 PRIOR ART
FIG. 9 is an exploded perspective view of the conventional push-on switch.
Figure 10:
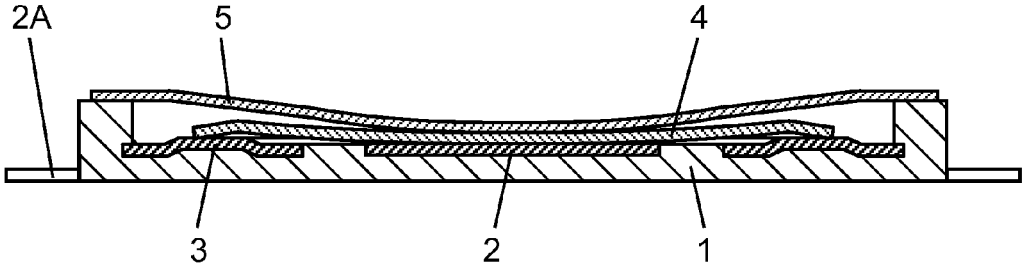
FIG. 10 PRIOR ART
FIG. 10 is a sectional view of the conventional push-on switch when it is depressed.

Projection 11B formed on first contact plate 11 is preferably shaped like a truncated cone because it can be formed with ease by embossing upward a sheet metal. However, the shape of projection 11B can be cylindrical or a polygon viewed from the top. These shapes also produce an advantage similar to what is discussed previously. As shown in FIG. 7, projection 11C can be recessed at its center, in other words, it can form a ring shape viewed from the top. This shape allows supporting the touching points to protrusions 14A not only by the outer wall but also by the inner side indirectly, so that the strength of projection 11C can be further increased. This structure more effectively prevents projection 11C from undergoing a cave-in and thus maintains a stable contact, when the switch is pushed, for an extended period of use.

First contact plate 11 and second contact plate 12 are not always made of stainless steel sheet that is silver-plated; for instance, they can be made of a silver-clad member as far as they are surface-treated for good conductivity and solderability. The surface treatment is not necessarily provided to the entire surfaces; for instance, the surfaces of first terminal 11A and second terminal 12A can be surface-treated for good solderability, and each center portion, i.e. the place carrying out the switch-contact function, of first contact plate 11 and second contact plate 12, can be surface-treated for good conductivity. First and second terminals 11A and 12A can be curved like a letter "J".

The expressions of directions used in this specification, e.g. up, down, left, and right, specify relative positional relations between the structural elements, and they do not specify absolute positional relations.

Push-on switch 100 of the present invention is capable of being used in various electronic devices that are required to be downsized or to be thinner in shape, and push-on switch 100 is also excellent in stability of contact when it is operated. Push-on switch 100 is thus useful for operating a variety of electronic devices.

What is claimed is:

1. A push-on switch comprising:

a first contact plate including a projection at a center and a first terminal at an end thereof;

a second contact plate facing a face of the projection of the first contact plate, and the second contact plate including an opening at a center and a second terminal at an end thereof;

a spacer interposed between the first contact plate and the second contact plate for bonding them together;

a dome-shaped movable contact including a protrusion protruding downward, for touching a top face of the second contact plate, wherein the protrusion faces the projection of the first contact plate via the opening with a predetermined space therebetween;

an air opening that communicates between an inside and an outside of the movable contact; and a lid holding the movable contact and mounted on the top face of the second contact plate, wherein the protrusion is disposed in a position to come into contact with the projection when the movable contact is pushed and reversed downward, and wherein the air opening is formed of a slit provided to the second contact plate.

2. The push-on switch of claim 1, wherein the protrusion is disposed in a position to come into contact with a vicinity of a rim of the top face of the projection when the movable contact is pushed and reversed downward.

3. The push-on switch of claim 1, wherein the projection of the first contact plate forms a ring shape.

4. The push-on switch of claim 1, wherein the spacer is formed on an entire section where the first contact plate overlaps with the second contact plate.

5. A push-on switch comprising:

a first contact plate including a projection at a center and a first terminal at an end thereof;

a second contact plate facing a face of the projection of the first contact plate, and the second contact plate including an opening at a center and a second terminal at an end thereof;

a spacer interposed between the first contact plate and the second contact plate for bonding them together;

a dome-shaped movable contact including a protrusion protruding downward, for touching a top face of the second contact plate, wherein the protrusion faces the projection of the first contact plate via the opening with a predetermined space therebetween; and a lid holding the movable contact and mounted on the top face of the second contact plate, wherein the protrusion is disposed in a position to come into contact with the projection when the movable contact is pushed and reversed downward, and wherein the spacer is made of a liquid crystal polymer, and bonds the first contact plate to the second contact plate together by an anchor effect.

6. The push-on switch of claim 5, wherein the protrusion is one of a plurality of protrusions spaced apart from one another on the movable contact, and the protrusions are all disposed opposite said projection of the first contact plate so that said protrusions are disposed in positions to come into contact with the projection when the movable contact is pushed and reversed downward.

7. The push-on switch of claim 5, wherein the protrusion is disposed in a position to come into contact with a vicinity of a rim of the top face of the projection when the movable contact is pushed and reversed downward.

8. The push-on switch of claim 5, wherein the projection of the first contact plate forms a ring shape.

9. The push-on switch of claim 5, wherein the spacer is formed on an entire section where the first contact plate overlaps with the second contact plate.

10. The push-on switch of claim 5, wherein the protrusion is one of a plurality of protrusions spaced apart from one another on the movable contact, and the protrusions are all disposed opposite said projection of the first contact plate so that said protrusions are disposed in positions to come into contact with the projection when the movable contact is pushed and reversed downward.

11. The push-on switch of claim 5 further comprising an air opening that communicates between an inside and an outside of the movable contact.

12. The push-on switch of claim 11, wherein the air opening is formed of a slit provided to the second contact plate.

* * * * *